US011207703B2

(12) United States Patent
Ishizuka

(10) Patent No.: US 11,207,703 B2
(45) Date of Patent: Dec. 28, 2021

(54) DISCHARGE PUMP

(71) Applicant: YOSHINO KOGYOSHO CO., LTD., Tokyo (JP)

(72) Inventor: Tetsuya Ishizuka, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 16/632,699

(22) PCT Filed: Jul. 6, 2018

(86) PCT No.: PCT/JP2018/025686
§ 371 (c)(1),
(2) Date: Jan. 21, 2020

(87) PCT Pub. No.: WO2019/026542
PCT Pub. Date: Feb. 7, 2019

(65) Prior Publication Data

US 2020/0139392 A1 May 7, 2020

(30) Foreign Application Priority Data

Jul. 31, 2017 (JP) ..... JP2017-147400

(51) Int. Cl.
*B05B 11/00* (2006.01)
*F04B 9/14* (2006.01)

(52) U.S. Cl.
CPC ..... *B05B 11/3052* (2013.01); *B05B 11/3001* (2013.01); *B05B 11/3069* (2013.01); *F04B 9/14* (2013.01)

(58) Field of Classification Search
CPC ..... B05B 11/3001; B05B 11/3052; B05B 11/306; B05B 11/3069; F04B 9/14
See application file for complete search history.

(56) References Cited

U.S. PATENT DOCUMENTS 5,794,821 A 8/1998 Foster et al.
2005/0279774 A1* 12/2005 Kuwahara ..... B05B 11/3077 222/383.1
2016/0167075 A1* 6/2016 Mizushima ..... B05B 11/0064 222/189.11

FOREIGN PATENT DOCUMENTS

CN 1128976 A 8/1996
CN 1145609 A 3/1997
(Continued)

OTHER PUBLICATIONS

Oct. 2, 2018 Search Report issued in International Patent Application No. PCT/JP2018/025686.
(Continued)

*Primary Examiner* — J C Jacyna
(74) *Attorney, Agent, or Firm* — Oliff PLC

(57) ABSTRACT

A discharge pump (2) includes a stationary suction part (A) which includes a cylinder (A1) having a first check valve (V1) at a lower part thereof, and a mounting member (A3) to be mounted on a neck part of a container body, and an actuating member (B) which includes a discharge head (B4), a stem (B2), a piston guide (B1), and an annular piston (B3), a second check valve (V2) being formed between a lower end part of the annular piston and a lower part of the piston guide, and in a fitting part between the stem and the piston guide, an engaging unit (E) which is configured to restrict the stem and the piston guide from idling each other when screwing of the actuating member to the stationary suction part is released and the actuating member is raised from the stationary suction part is provided.

6 Claims, 10 Drawing Sheets

(56) References Cited

FOREIGN PATENT DOCUMENTS

| | | | |
|---|---|---|---|
| CN | 104627510 | A | 5/2015 |
| CN | 205989896 | U | 3/2017 |
| JP | 2013-163523 | A | 8/2013 |
| JP | 2014-198309 | A | 10/2014 |
| JP | 2014-199036 | A | 10/2014 |
| JP | 2015-085990 | A | 5/2015 |
| JP | 2015-105117 | A | 6/2015 |
| JP | 2015-163523 | A | 9/2015 |
| JP | 2015-224072 | A | 12/2015 |
| JP | 2015-227184 | A | 12/2015 |

OTHER PUBLICATIONS

Dec. 25, 2020 Office Action issued in Chinese Patent Application No. 201880049743.4.
Mar. 19, 2021 Extended European Search Report issued in European Patent Application No. 18841952.7.
May 26, 2021 Office Action issued in Japanese Patent Application No. 2017-147400.

* cited by examiner

DISCHARGE PUMP

TECHNICAL FIELD

The present invention relates to a discharge pump.

Priority is claimed on Japanese Patent Application No. 2017-147400, filed Jul. 31, 2017, the content of which is incorporated herein by reference.

BACKGROUND ART

As a discharge pump, a discharge pump described in Patent Document 1 is known. This discharge pump is equipped with a stationary suction part in which a cylinder including a first check valve on a lower part thereof is vertically provided inside a container body via a mounting member on a neck part of the container body, and an actuating member in which an upper part of a piston guide is fit to a stem hanging down from a discharge head, a cylindrical piston attached to an intermediate part of the piston guide in a vertical direction to freely move up and down is brought into sliding contact with an inner peripheral surface of the cylinder, and a second check valve is formed between a lower end part of the cylindrical piston and a lower part of the piston guide. Due to the vertical movement of the actuating member, liquid in the container body is sucked into the cylinder via the first check valve, and liquid in the cylinder is discharged from the discharge head via the second check valve.

DOCUMENT OF RELATED ART

Patent Document

Patent Document 1: Japanese Unexamined Patent Application, First Publication No. 2013-163523

SUMMARY OF INVENTION

Technical Problem

In the discharge pump of Patent Document 1, when not in use, the actuating member is screwed to the stationary suction part in a state in which the actuating member is lowered with respect to the cylinder to a lowest position, and when in use, the screwing of the actuating member to the stationary suction part is released, the actuating member is raised from the stationary suction part and is provided to be movable up and down with respect to the cylinder.

In a manufacturing process of the discharge pump, silicone is normally applied to facing surfaces between the piston guide and the cylindrical piston so that the cylindrical piston can easily slide with respect to the piston guide. However, there are cases in which there is a clumsiness in the manufacturing process of the discharge pump, and silicone is not applied to the facing surfaces of the piston guide and the cylinder by mistake, or silicone is incorrectly attached to the fitting surfaces of the piston guide and the stem. In such cases, there is a possibility that the function of the discharge pump will be hindered.

That is, when releasing the screwing of the actuating member to the stationary suction part at the time of an initial use and raising the actuating member, there is a possibility that the piston guide may become detached from the stem and remain at an original position.

An object of the present invention is to provide a discharge pump in which, when releasing screwing of an actuating member to a stationary suction part at the stage of initial use and raising the actuating member, it is possible to curb a piston guide being left behind with respect to a stem.

Solution to Problem

According to an aspect of the present invention, there is provided a discharge pump including: a stationary suction part which includes a cylinder having a first check valve at a lower part thereof, and a mounting member to be mounted on a neck part of a container body, the cylinder being capable of being vertically provided to an inside of the container body via the mounting member; and an actuating member which includes a discharge head, a stem hanging down from the discharge head, a piston guide having an upper part fitted to the stem, and an annular piston attached to an intermediate part in a vertical direction of the piston guide to freely move up and down and configured to come into slide contact with an inner peripheral surface of the cylinder, a second check valve being formed between a lower end part of the annular piston and a lower part of the piston guide, in which the stationary suction part and the actuating member are configured such that, when not in use, the actuating member is screwed to the stationary suction part in a state in which the actuating member is lowered with respect to the cylinder to a lowest position, the stationary suction part and the actuating member are configured such that, when in use, screwing of the actuating member to the stationary suction part is released, the actuating member is raised from the stationary suction part and is provided to be vertically movable with respect to the cylinder, and by vertical movement of the actuating member, liquid in the container body is sucked up into the cylinder via the first check valve, and the liquid in the cylinder is discharged from the discharge head via the second check valve, and in a fitting part between the stem and the piston guide, an engaging unit which is configured to restrict the stem and the piston guide from idling each other when screwing of the actuating member to the stationary suction part is released and the actuating member is raised from the stationary suction part is provided.

The engaging unit which prevents the stem and the piston guide from idling each other is provided. By preventing the idling, the frictional resistance of the fitting surfaces of the stem and the piston guide is prevented from decreasing, and as a result, it is possible to prevent the piston guide from being left behind from the stem when screwing of the actuating member to the stationary suction part is released and the actuating member is raised from the stationary suction part.

The engaging unit may be formed by an engaging recess which is provided on one of the upper part of the piston guide and a corresponding part of the stem corresponding to the upper part of the piston guide and has an open upper end, and a locking protrusion which is provided on the other of the upper part of the piston guide and the corresponding part of the stem and capable of being inserted into the engaging recess from an upper end side.

In this case, by providing the engaging recess in one of the upper part of the piston guide and the corresponding part of the stem, and by providing the locking protrusion on the other of the upper part of the piston guide and the corresponding part of the stem to be inserted into the engaging recess from the upper end side, the engaging unit is formed. Therefore, the assembling work of the piston guide with respect to the stem does not become troublesome.

The locking protrusion may be formed as a vertical rib protruding inward from an inner peripheral surface of the stem, extending in the vertical direction, and configured to abut on a side surface of the engaging recess.

In this case, the locking protrusion is formed as a vertical rib protruding inward from the inner peripheral surface of the stem. As a result, since the vertical rib can be made to abut on the side surface of the engaging recess to be longer in the vertical direction, it is possible to increase the engaging force as compared to, for example, a form of a horizontal rib with the same protruding length.

The piston guide may have a bottom wall, and a guide cylinder erected from a peripheral edge of the bottom wall and fitted to the stem, a second check valve seat being formed outside a lower part of the guide cylinder, the engaging recess may be a slit groove formed from the lower part to an upper end of a cylinder wall of the guide cylinder, and the slit groove is configured to also serve as a liquid passage hole of the guide cylinder, and the vertical rib may be attached to a portion of the inner peripheral surface of the stem corresponding to the upper part of the guide cylinder.

In this case, the engaging recess is formed as a slit groove that also serves as a liquid passage hole and has an open upper end from the lower part to the upper end of the guide cylinder, and the vertical rib is formed on the inner peripheral surface of the stem, as the locking protrusion engaged with the side edge of the slip groove.

Since the engaging recess can also serve as a liquid passage hole for the piston guide, the piston guide does not become complicated.

A plurality of the vertical ribs may be vertically provided on the inner peripheral surface of the stem at regular gaps narrower than a width in a circumferential direction of the engaging recess, and when the guide cylinder is inserted into the stem, at least one of the vertical ribs may enter the engaging recess, and the vertical ribs may be formed to a size such that the vertical rib which does not enter the engaging recess and is deformed by being pressed against the outer surface of the guide cylinder does not hinder insertion of the guide cylinder into the stem.

In this case, a plurality of vertical ribs are provided vertically at regular gaps on the inner peripheral surface of the stem. Since the gaps are narrower than the width in the circumferential direction of the engaging recess, even if a specific vertical rib and the engaging recess are not aligned, one of the vertical ribs enters the engaging recess, and is engaged with the side surface of the engaging recess as the locking protrusion. At this time, the remaining vertical ribs are deformed by being pressed against the guide cylinder. The vertical rib is formed to such a size that the vertical rib deformed by pressure contact with the outer surface of the guide cylinder does not hinder the piston guide from being inserted into the stem.

The cross-sectional shape of the vertical rib may be formed in a circular arc shape raised inward from the inner peripheral surface of the stem.

In this case, even in a state in which the guide cylinder rides on the vertical rib when the guide cylinder is inserted into the stem, the resistance at the time of insertion can be reduced.

The vertical rib may have a band-like engaging surface which is provided on at least one side in the circumferential direction of the stem and extends in the vertical direction.

In this case, the vertical rib has a band-like engaging surface which is provided on one or both sides of the stem in the circumferential directions and extends in the vertical direction. As a result, when the stem is rotated with respect to the piston guide, the band-like engaging surface and the engaging recess abut on each other and engage with each other, and thus, the engagement action is strengthened, and it is possible to further reliably restrict the idling between the piston guide and the stem.

Advantageous Effects of Invention

According to the present invention, since the engaging unit which restricts the stem and the piston guide from idling each other when the screwing of the actuating member to the stationary suction part is released and the actuating member is raised from the stationary suction part is provided at a fitting part between the stem and the piston guide, it is possible to prevent the piston guide from being detached from the stem.

DESCRIPTION OF EMBODIMENTS

Figure 1:
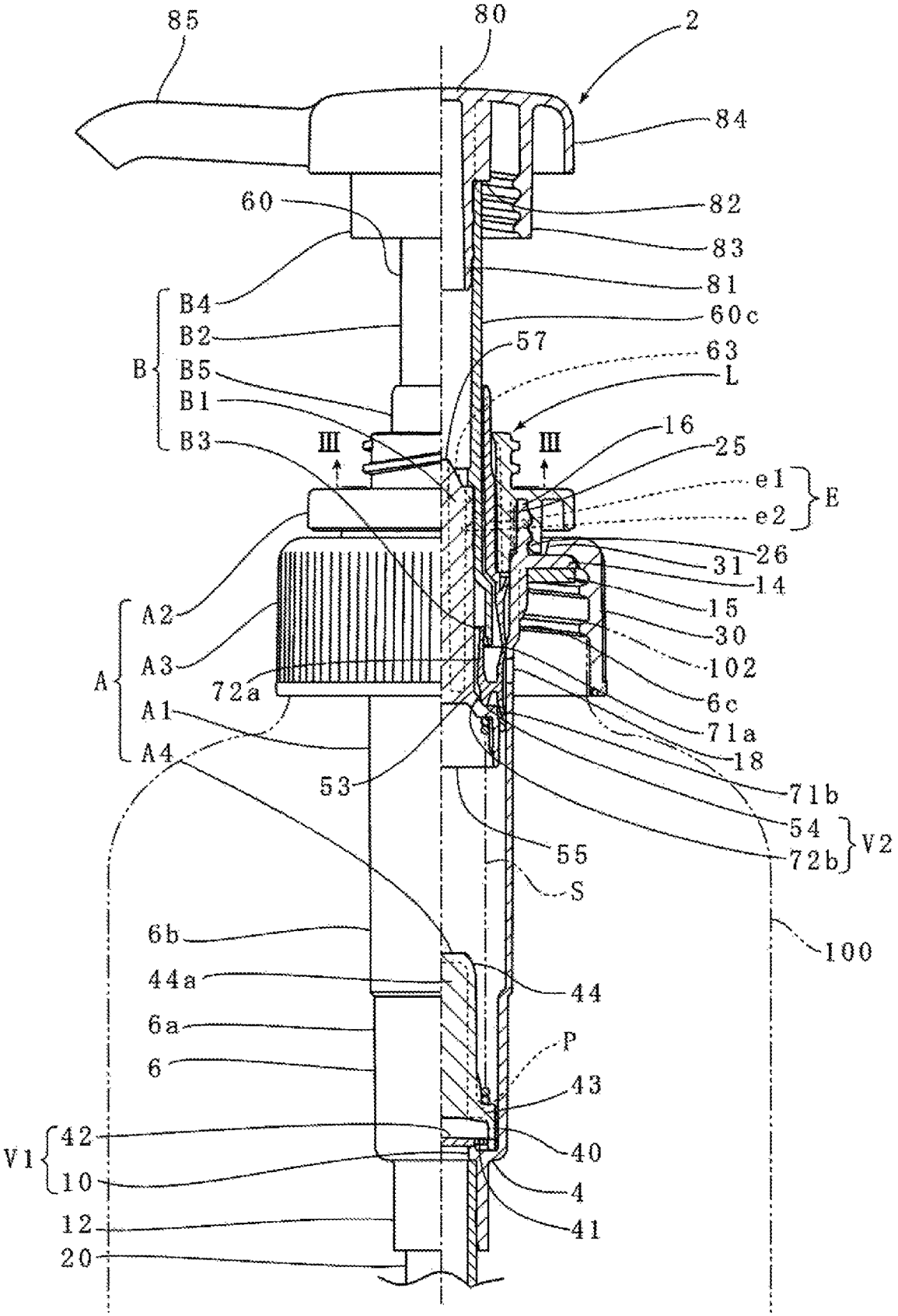
FIG. 1 is a half vertical sectional view of a discharge pump according to a first embodiment of the present invention.

FIGS. 1 to 7 show a discharge pump according to a first embodiment of the present invention. In FIG. 1, a reference numeral 100 denotes a container body, and a reference numeral 102 denotes a neck part. For convenience of explanation, the basic items of the configuration of the present invention will be described first.

The discharge pump 2 is equipped with a stationary suction part A and an actuating member B. The stationary suction part A and the actuating member B can be mainly formed of a synthetic resin, and a metal or a flexible elastomer may be used in combination therewith as required.

The stationary suction part A is equipped with a cylinder A1, a ring cap A2, a mounting member A3, and a suction valve member A4.

The cylinder A1 is equipped with an annular bottom wall 4, a peripheral wall 6, a first check valve seat 10, a pipe fitting cylinder part 12, an outward flange 14, a packing 15, an extension wall part 16, an outside air introduction hole 18, and a pipe 20. The cylinder A1 has a bottomed cylindrical shape in which the peripheral wall 6 is erected from an outer edge part of the annular bottom wall 4 and an upper end is open. The first check valve seat 10 protrudes from an inner edge part of the annular bottom wall 4. A pipe fitting cylinder part 12 is vertically provided below the peripheral edge part of the annular bottom wall 4. The outward flange 14 protrudes from the upper end of the peripheral wall 6. Further, the cylindrical extension wall part 16 is erected from the upper end of the peripheral wall 6 via the inner peripheral part of the outward flange 14. The packing 15 is attached to a lower surface of the outward flange 14. The peripheral wall 6 is equipped with a first peripheral wall part 6*a*, a second peripheral wall part 6*b*, and a third peripheral wall part 6*c* that are provided so that diameters thereof sequentially increase from the lower end. The outside air introduction hole 18 is bored at the upper part of the second peripheral wall part 6*b*. The upper end of the pipe 20 is fitted to the pipe fitting cylinder part 12, and the lower end of the pipe 20 is made to hang down from the inner bottom part of the container body 100.

Figure 2:
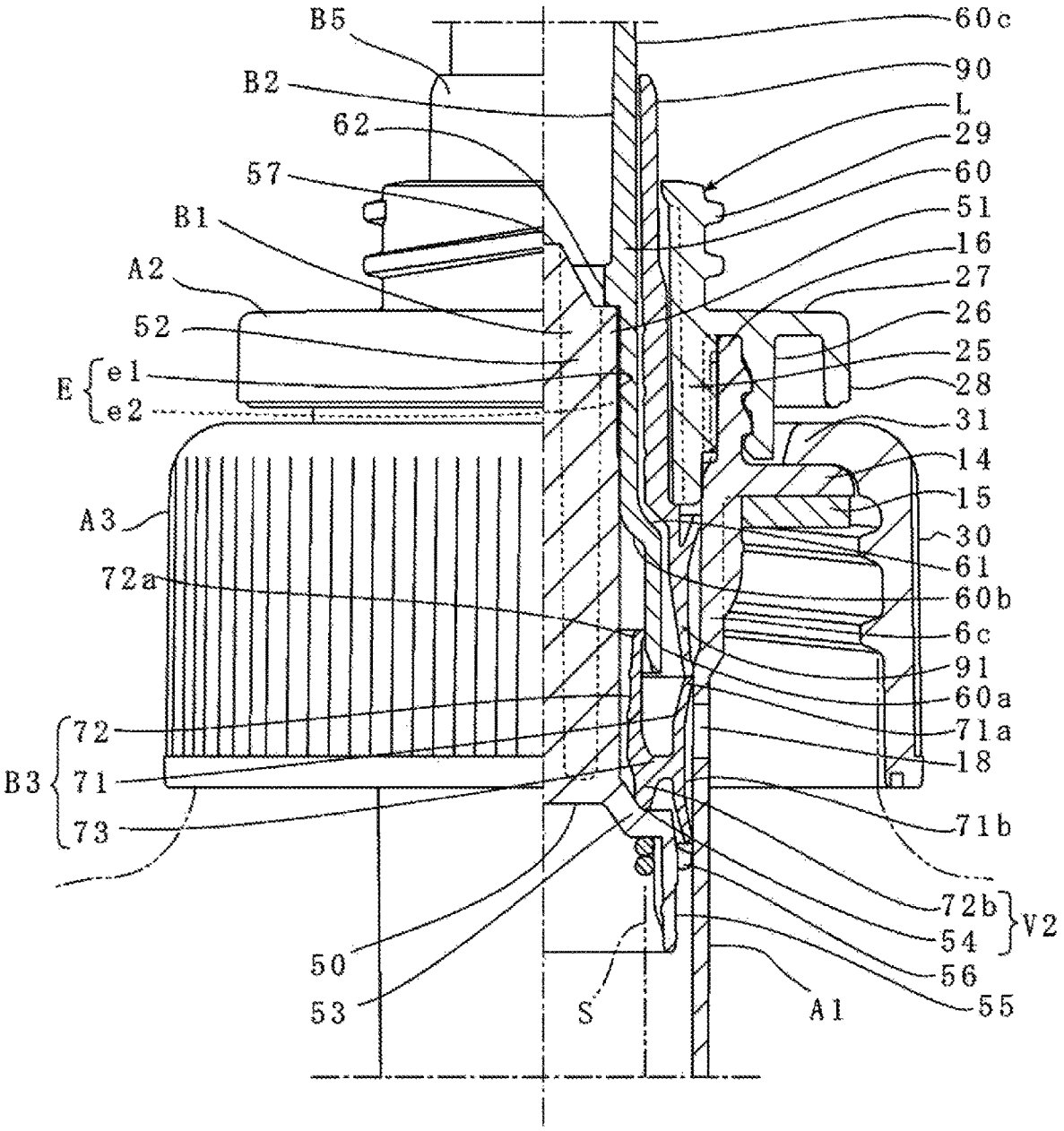
FIG. 2 is an enlarged view of a main part of the discharge pump of FIG. 1.

The ring cap A2 is fitted to the extension wall part 16. As shown in FIG. 2, the ring cap A2 is equipped with an inner fitting cylinder part 25, an outer fitting cylinder part 26, a ring-like top plate 27, a cap peripheral wall 28, and an extension portion 29. The inner fitting cylinder part 25 is fitted to the inner periphery of the extension wall part 16 so that mutual rotation is prevented. The outer fitting cylinder part 26 is fitted to the outer periphery of the extension wall part 16 to prevent upward extraction therefrom. The inner fitting cylinder part 25 and the outer fitting cylinder part 26 are vertically provided from the back surface of the top plate 27. The cap peripheral wall 28 is vertically provided from the outer peripheral edge of the top plate 27. Further, in the present embodiment, the inner fitting cylinder part 25 extends above the top plate 27, and this extension portion 29 is used as a stationary part L with respect to the discharge head B4 to be described below. However, a structure of the stationary part L can be changed as appropriate. For example, a screw thread may be provided on the outer surface of the cap peripheral wall 28 of the ring cap A2 so that it can be screwed to an appropriate place (for example, a head peripheral wall 84) of the discharge head B4.

The mounting member A3 is equipped with a mounting cylinder part 30 that can be fitted (screwed in the shown example) to the outer periphery of the neck part 102 of the container body 100, and an inward flange-like top wall part 31 protruding from the upper part of the mounting cylinder part 30. The inward flange-like top wall part 31 is mounted between the ring cap A2 and the outward flange 14 to be freely rotatable.

As shown in FIG. 1, the suction valve member A4 is equipped with a leg cylinder part 40, a plurality of elastic connecting pieces 41, a first check valve plate 42, an inward flange-like connecting part 43, and a pedestal part 44 having a top. The leg cylinder part 40 is placed on the annular bottom wall 4. The plurality of elastic connecting pieces 41 are provided at equal gaps in a circumferential direction from the inner periphery of the lower part of the leg cylinder part 40. The first check valve plate 42 is supported at the center via the plurality of elastic connecting pieces 41. The first check valve plate 42 is brought into elastic pressure contact with the top of the first check valve seat 10, and the first check valve seat 10 and the first check valve plate 42 form a first check valve V1. The pedestal part 44 is erected from the upper part of the leg cylinder part 40 via the connecting part 43. The inside of the leg cylinder part 40 communicates with a portion above the connecting part 43 of the cylinder A1 via a liquid passage P.

In the shown example, the leg cylinder part 40 is fitted to the lower part of the first peripheral wall part 6*a*, the connecting part 43 is formed as a plurality of connecting rods, and a gap between the connecting rods is formed as the liquid passage P. Further, the pedestal part 44 is equipped with a pair of side plates disposed on both sides sandwiching an axis of the cylinder A1 in a radial direction and facing each other, vertical plate-like first reinforcing wall parts 44*a* which connect the side plates to each other, and a top plate integrally connected to each upper end part of the side plates and the first reinforcing wall parts 44*a*. However, the structures thereof can be changed as appropriate.

The actuating member B is equipped with a piston guide B1, a stein B2, an annular piston B3, a discharge head B4, and a blocking cylinder member B5.

Figure 3:
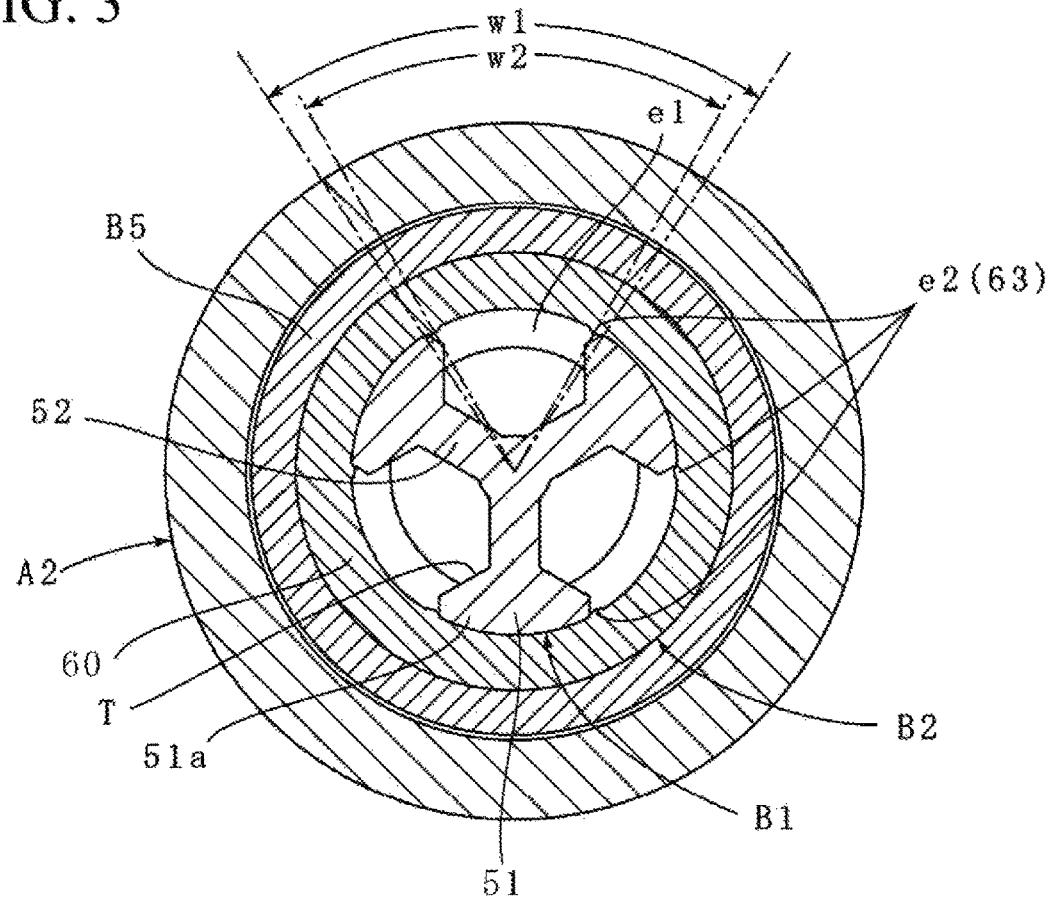
FIG. 3 is a cross-sectional view of the main part of FIG. 2.

The piston guide B1 is equipped with a bottom wall 50, a guide cylinder 51 having an open upper end, a plurality of second reinforcing wall parts 52, an outward flange-like wall part 53, a second check valve seat 54, a seal cylinder part 55, a plurality of space ribs 56, and a pointed end part 57. The guide cylinder 51 is erected from the peripheral edge of the bottom wall 50. In the shown example, the second reinforcing wall part 52 is formed inside the guide cylinder 51. In the present embodiment, as shown in FIG. 3, the plurality (three in the shown example) of second reinforcing wall parts 52 extend outward from the central part and are connected to the guide cylinder 51. In the shown example, the pointed end part 57 is formed at the upper end of the piston guide B1 by erecting the inner end side of the second reinforcing wall part 52 to be higher than the outer end side of the second reinforcing wall part 52. However, this shape can be changed as appropriate. In addition, a liquid passage hole to be described below is formed in a cylinder wall part between the connecting portions of the guide cylinder 51 and the second reinforcing wall part 52. The shapes can be changed as appropriate. The outward flange-like wall part 53 protrudes outward from the lower end part of the outer periphery of the guide cylinder 51. The upper surface of the outward flange-like wall part 53 is the second check valve seat 54. The seal cylinder part 55 is vertically provided downward from the outer peripheral edge part of the outward flange-like wall part 53. Further, a lower surface of the outward flange-like wall part 53 is used as a locking surface of a coil spring S. The plurality of space ribs 56 protrude from the upper part of the outer surface of the seal cylinder part 55 at gaps in the circumferential direction.

Figure 6:
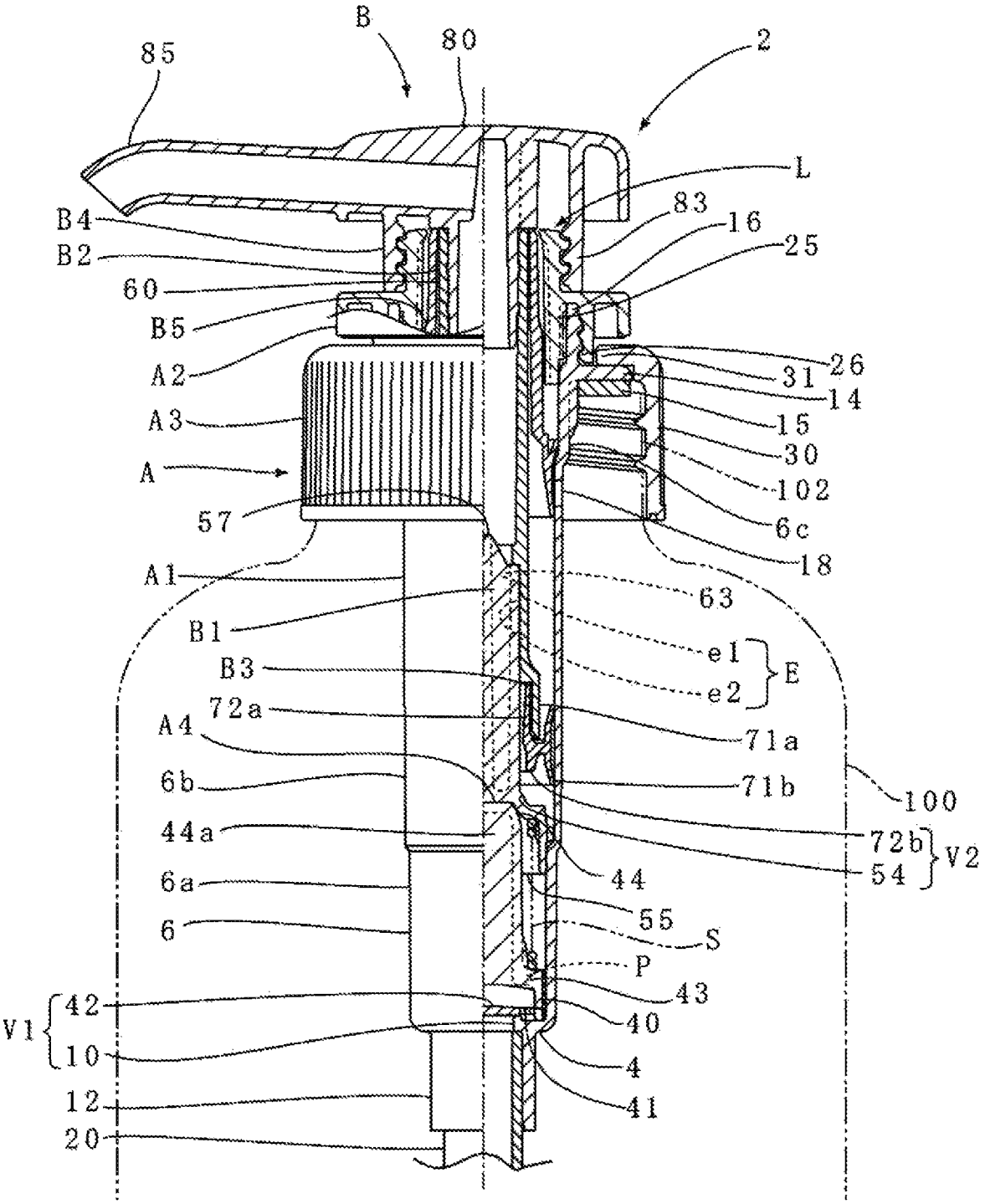
FIG. 6 is a half vertical sectional view showing a non-used state (an initial state) of the discharge pump of FIG. 1.

As shown in FIG. 6, the seal cylinder part 55 is closely fitted to the upper end part of the inner periphery of the first peripheral wall part 6*a* of the cylinder A1 to vertically block the inside of the cylinder A1 when the actuating member B is locked to the stationary part L in the state of being lowered to the lowest position. From the state of FIG. 6, when the screwing of the actuating member B to the stationary suction part A is released and the actuating member B is lifted, the seal cylinder part 55 is detached from the first peripheral wall part 6*a*, and the vertical communication in the cylinder A1 is enabled as shown in FIG. 1.

In order to facilitate the separation of the seal cylinder part 55 from the first peripheral wall part 6*a*, it is preferable to apply silicone or the like to abutment surfaces between the first peripheral wall part 6*a* and the seal cylinder part 55.

However, there may be a case in which the silicone application is not performed or a case in which the silicone application is inappropriate or insufficient due to some error.

The stem B2 is equipped with a stem cylinder 60, an upward stepped part 61, an annular rib 62, and a vertical rib 63. The stem cylinder 60 is fitted to the outer surface of the upper part of the guide cylinder 51, and is erected from this fitting part. The discharge head B4 is connected to the upper end of the stem cylinder 60.

As shown in FIG. 2, the stem cylinder 60 is equipped with a large-diameter cylinder part 60*a*, a reduced-diameter part 60*b*, and a small-diameter cylinder part 60*c*. The small-diameter cylinder part 60*c* is erected from the upper end of the large-diameter cylinder part 60*a* via the reduced-diameter part 60*b*. The small-diameter cylinder part 60*c* is longer than the large-diameter cylinder part 60*a*.

Although the shown reduced-diameter part 60*b* has a tapered shape that gradually decreases in diameter toward the upper end, it may be formed in an inward flange shape. The upper surface of the reduced-diameter part 60*b* is the upward stepped part 61.

The large-diameter cylinder part 60*a* disposed outside the guide cylinder 51 hangs down at an interval from the guide cylinder 51. Further, the lower end of the large-diameter cylinder part 60*a* hangs down with a gap from the second check valve seat 54.

An annular rib 62 is provided around the inner surface of the small-diameter cylinder part 60*c* at a certain distance from the lower end of the small-diameter cylinder part 60*c*. The upper end surface of the guide cylinder 51 abuts against the lower surface of the annular rib 62. In other words, there is a design such that a sufficient fitting strength between the guide cylinder 51 and the small-diameter cylinder part 60*c* can be obtained by fitting the guide cylinder 51 into the small-diameter cylinder part 60*c* until it abuts against the annular rib 62 to secure a sufficient fitting length between the guide cylinder 51 and the small-diameter cylinder part 60*c*.

However, there may be a case in which sufficient fitting strength cannot be obtained, for example, due to silicone incorrectly adhering to the fitting part between the guide cylinder 51 and the small-diameter cylinder part 60*c*.

Details of the vertical rib 63 will be described below.

The annular piston B3 is equipped with an outer cylinder part 71, an inner cylinder part 72, and a connecting wall part 73. As shown in FIG. 2, the annular piston B3 has a cross section of a H shape in which intermediate parts in the vertical direction of the outer cylinder part 71 and the inner cylinder part 72 are connected to each other by the connecting wall part 73. An upper part of the outer cylinder part 71 is formed in a reverse skirt-like seal part 71*a* that gradually increases in diameter toward the upper end, and a lower part of the outer cylinder part 71 is formed in a skirt-like seal part 71*b* that gradually increases in diameter toward the lower end. Each of the seal parts 71*a* and 71*b* is liquid-tightly fitted to the inner surface of the peripheral wall 6 (the second peripheral wall part 6*b* in the shown example) of the cylinder A1. The upper part of the inner cylinder part 72 is a vertically cylindrical inner upper seal part 72*a*, and the lower part of the inner cylinder part 72 is the second check valve body 72*b* hanging down toward the second check valve seat 54. The inner upper seal part 72*a* is fitted to the inner surface of the large-diameter cylinder part 60*a* to freely move up and down and liquid-tightly. The second check valve body 72*b* and the second check valve seat 54 form a second check valve V2. That is, when the annular piston B3 is relatively lowered with respect to the piston guide B1 and the stem B2, the second check valve body 72*b* presses against the top of the second check valve seat 54 to close the second check valve V2. When the annular piston B3 relatively rises with respect to the piston guide B1 and the stem B2 from this state, the second check valve V2 opens.

As shown in FIG. 1, the discharge head B4 is equipped with a top wall 80, a small-diameter first connection cylinder part 81, a downward stepped part 82, a large-diameter second connection cylinder part 83, a head peripheral wall 84, and a nozzle 85. Each of the first connection cylinder part 81 and the second connection cylinder part 83 is vertically provided from the center part of the back surface of the top wall 80. The head peripheral wall 84 hangs down from the outer peripheral part of the top wall 80. A proximal end of the nozzle 85 opens at the upper end part of the first connection cylinder part 81. The nozzle 85 extends from the first connection cylinder part 81 through the second connection cylinder part 83 and the head peripheral wall 84, and protrudes outward from the head peripheral wall 84. The first connection cylinder part 81 is fitted to the inner surface of the upper end part of the small-diameter cylinder part 60*c* of stem B2. In the shown example, a plurality of vertical ribs (large outer diameter parts) are provided on the upper part of the first connection cylinder part 81, and the lower surface of the vertical rib is formed as the downward stepped part 82. The upper end surface of the small-diameter cylinder part 60*c* abuts against the inner peripheral part of the downward stepped part 82. A screw thread is formed on the inner surface of the second connection cylinder part 83. In a state in which the actuating member B is pushed down and lowered to the lowest position, this screw thread can be screwed to the stationary part L of the ring cap A2 to maintain the lowered state of the actuating member B.

The actuating member B is always biased upward by the coil spring S interposed between the lower surface of the outward flange-like wall part 53 of the piston guide B1 and the upper surface of the connecting part 43 of the suction valve member A4.

Figure 7:
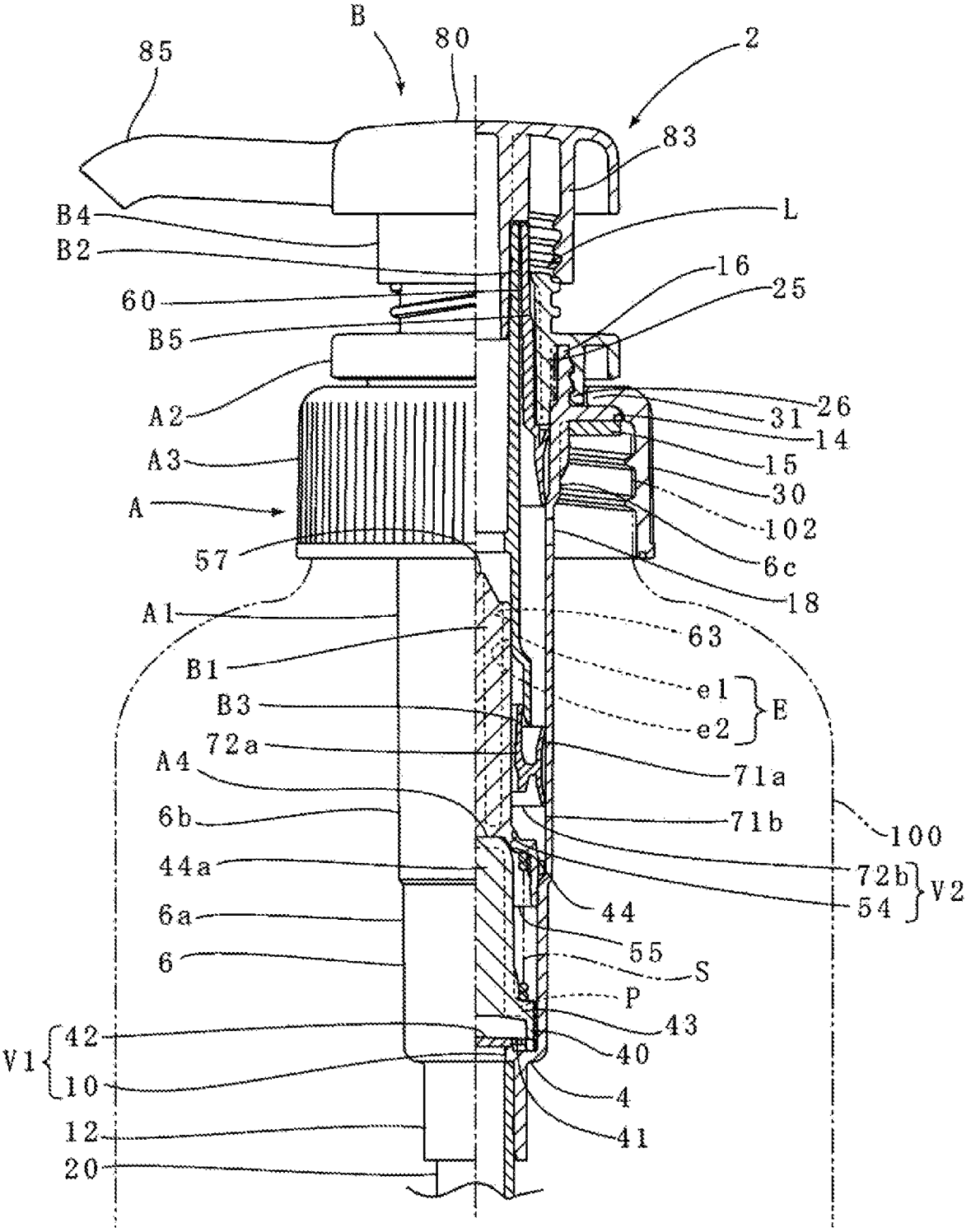
FIG. 7 is a half vertical sectional view of the discharge pump showing a stage in the middle of assembling the actuating member to the stationary suction part and reaching the state of FIG. 6.

When assembling the actuating member B to the stationary suction part A, as shown in FIG. 7, the actuating member B is inserted into the cylinder A1 from above and screwed to the mounting member A3.

The blocking cylinder member B5 is equipped with a base cylinder part 90 and an annular sliding blocking part 91 as shown in FIG. 2. The upper end part of the base cylinder part 90 protrudes from the opening at the upper end of the stationary suction part A. The base cylinder part 90 is fitted to the lower part of the outer periphery of the stem B2 to be vertically movable with a gap for introducing the outside air being secured inside the base cylinder part 90. The sliding blocking part 91 is provided to protrude from the lower part of the outer periphery of the base cylinder part 90, and is fitted to the upper part of the inner periphery of the cylinder A1 to be vertically movable.

When the actuating member B shifts to a state of being lowered to the lowest position, the blocking cylinder member B5 is pushed down by the outer peripheral part of the downward stepped part 82 and shifts to a state of blocking the outside air introduction hole 18. When the actuating member B shifts to an upper limit position of a stroke, the blocking cylinder member B5 is pushed up by the upward stepped part 61 or the seal part 71*a* and shifts to a state in which the outside air introduction hole 18 is open. When the actuating member B moves up and down for liquid discharge, the blocking cylinder member B5 is configured to maintain a state in which the outside air introduction hole 18 is open.

Further, when the actuating member B is pushed down from the upper limit position of the actuating member B and is screwed and locked to the stationary suction part A, the downward stepped part 82 presses down the upper surface of the base cylinder part 90, and thus, as shown in FIG. 6, the blocking cylinder member B5 is pushed down to a position at which the sliding blocking part 91 blocks the outside air introduction hole 18. Further, when screwing of the actuating member B is released from this state and the actuating member B is raised, the upward stepped part 61 pushes up the lower surface of the base cylinder part 90 or the seal part 71*a* pushes up the lower surface of the sliding blocking part 91, and the upper edge of the sliding blocking part 91 is locked to the lower surface of the inner fitting cylinder part 25 as shown in FIG. 2.

A case in which the silicone application to the abutment surfaces between the first peripheral wall part 6*a* and the seal cylinder part 55 is not performed, or a case in which the silicone application is unsuitable or inadequate may be assumed. Further, a case in which sufficient fitting strength between the guide cylinder 51 and the small-diameter cylinder part 60*c* cannot be obtained due to, for example, silicone incorrectly adhering to the fitting part between the guide cylinder 51 and the small-diameter cylinder part 60*c* may be assumed. In these cases, when unscrewing the actuating member B and raising the actuating member B, there is a possibility that the piston guide B1 may be detached from the stem B2 and left in its original position.

This is considered to be due to the fact that a frictional (fitting) force between the piston guide B1 and the annular piston B3 and a frictional (fitting) force between the annular piston B3 and the cylinder A1 exceed a frictional (fitting) force between the piston guide B1 and the stem B2.

The patent applicant found that it is possible to prevent the piston guide B1 from being detached, by restricting the idling between the piston guide B1 and the stem B2, when unscrewing the actuating member B and raising the actuating member B.

In the present invention, an engaging unit E for preventing mutual rotation is provided between the piston guide B1 and the stem B2.

In the present embodiment, the engaging unit E is equipped with an engaging recess e1 which is formed on the outer surface of the guide cylinder 51, and a locking protrusion e2 which is formed on an inner surface of a corresponding part of the stem cylinder 60 corresponding to the guide cylinder 51 (facing the guide cylinder 51) and is meshed with the engaging recess e1 as shown in FIG. 3.

The engaging recess e1 also serves as a liquid passage hole of the guide cylinder 51 in the shown example. That is, as shown by a dotted line in FIG. 2, a slit groove extending from the lower end side to an upper end of a cylinder wall of the guide cylinder 51 is formed. The engaging recess e1 is provided so that the locking protrusion e2 is engaged with an upper half portion of the slit groove facing the inner surface of the stem B2. This configuration can be changed as appropriate, and the engaging recess e1 may be provided separately from the liquid passage hole.

In the shown example, as shown in FIG. 3, a plurality of (three in the shown example) engaging recesses e1 are provided at equal gaps on the cylinder wall of the guide cylinder 51, leaving arcuate cylinder wall parts 51*a* having a circular arc shape. The widths in the circumferential direction of the respective engaging recesses e1 are equal to each other, and the width in the circumferential direction of the engaging recess e1 is larger than the width in the circumferential direction of the arcuate cylinder wall part 51*a*. The side surfaces of the arcuate cylinder wall part 51*a* constituting both side surfaces of each engaging recess e1 are formed so that the width of the engaging recess e1 increases toward the outside, and the locking protrusion e2 is locked to at least one of the side surfaces. In the shown example, as shown in FIG. 3, a padding part T which becomes thicker toward the second reinforcing wall part 52 is attached to the back surface side of the arcuate cylinder wall part 51*a*, but the structure can be changed as appropriate.

Figure 4:
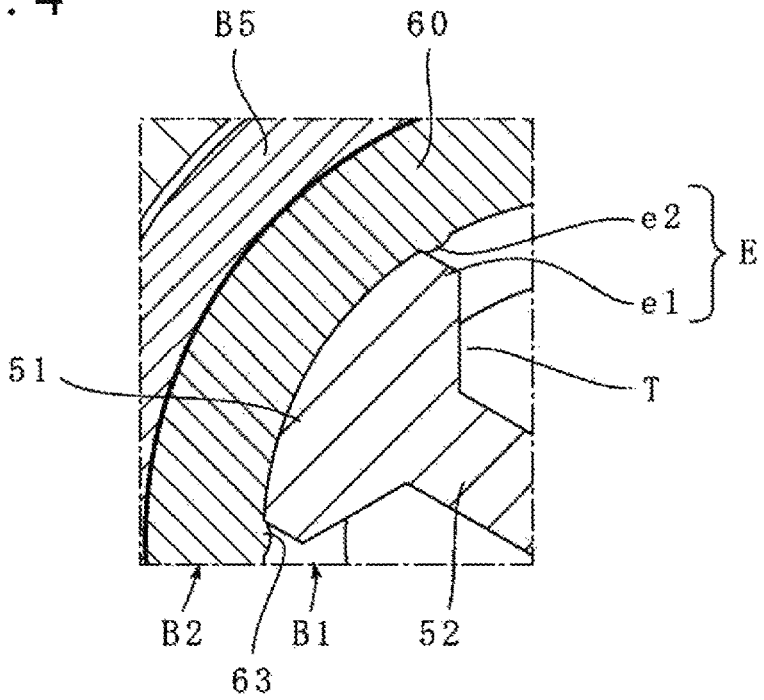
FIG. 4 is a further enlarged view of the main part of FIG. 3.
Figure 5:
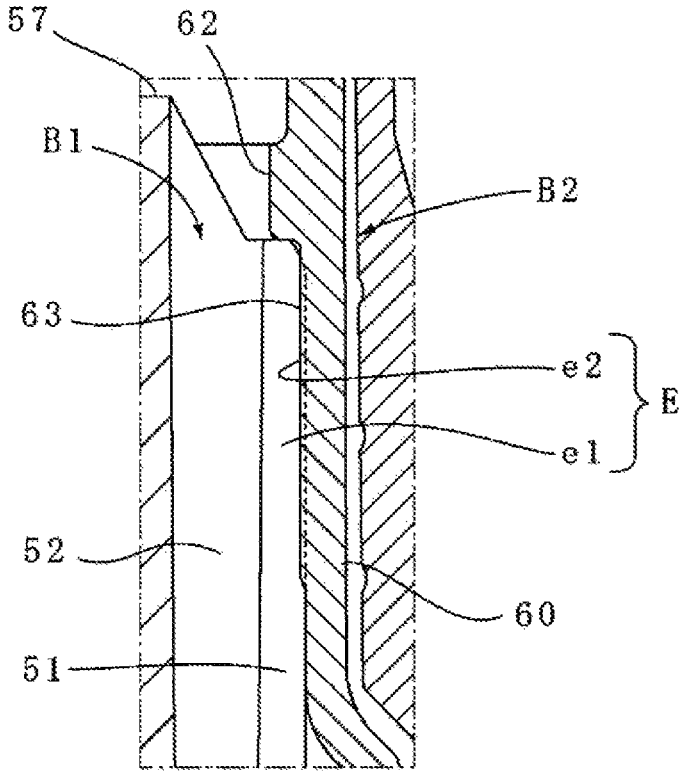
FIG. 5 is a vertical sectional view of the main part of FIG. 3 as viewed from a side part.

As shown in FIG. 5, the locking protrusion e2 is formed as a vertical rib 63 that protrudes inward from a portion of the inner peripheral surface of the stem cylinder 60 facing the upper part of the guide cylinder 51. In the shown example, the locking protrusion e2 (the vertical rib 63) is formed on the inner peripheral surface of the small-diameter cylinder part below the annular rib 62. In this embodiment, the cross-sectional shape of the vertical rib 63 is formed in a substantially flat circular arc shape raised toward the cylinder hole side (inside) of the guide cylinder 51 as shown in FIG. 4. However, the shape of the vertical rib 63 can be changed as appropriate.

As shown in FIG. 4, an inward protruding length of the vertical rib 63 is set to such a length that the vertical rib 63 can abut against the side surface of the engaging recess e1 to prevent idling of the piston guide B1 with respect to the stem B2. The locking protrusion e2 (the vertical rib 63) of the shown example is formed in a rib having an arcuate cross-section that is gently raised inward from the inner peripheral surface of the stem B2.

Furthermore, it is preferable that the protruding length of the vertical rib 63 is designed such that when the piston guide B1 is fitted to the stein B2, even in a state in which the vertical rib 63 faces a portion of the stem cylinder 60 other than the location in which the engaging recess e1 is formed, that is, the vertical rib 63 faces the arcuate cylinder wall part 51*a*, by pressing of the guide cylinder 51 into the stem cylinder 60, the vertical rib 63 can be deformed by the pressure contact with the guide cylinders 51 and the guide cylinder 51 can be pushed into the stem cylinder 60. The reason for this will be described below.

In the present embodiment, the plurality of vertical ribs 63 are provided on the inner peripheral surface of the stem cylinder 60, preferably at equal gaps. In a preferred shown example, multiple vertical ribs 63 (six in the shown example) of the number of engaging recesses e1 are provided, the gap w2 between the locking protrusions e2 (the vertical ribs 63) is set to be smaller than the width w1 in the circumferential direction of the engaging recess e1, and two vertical ribs 63 are configured to be disposed in one engaging recess e1.

The reason for this is as follows. If the specific vertical rib 63 and the engaging recess e1 are aligned when fitting the piston guide B1 to the stem B2, the labor of the fitting operation increases. Therefore, a size (a protruding length) of the vertical rib 63 is set so that the guide cylinder 51 can be forcibly pushed into the stem cylinder 60 without performing the alignment. There is a possibility that one of the two vertical ribs 63 corresponding to one engaging recess e1 may be pressed against the arcuate cylinder wall part 51*a* of the guide cylinder 51 and may be deformed. Even if the deformed vertical rib 63 is crushed, the other vertical rib 63 enters the engaging recess e1 without being deformed, and can be engaged with the side surface of the engaging recess e1 as the locking protrusion e2. Accordingly, it is possible to prevent the idling between the piston guide B1 and the stem B2, by the engaging force between the engaging recess e1 and the locking protrusion e2.

In this case, the stem B2 or the piston guide B1 may be formed of a material that is flexible to the extent that the guide cylinder 51 can be pushed therein. Further, when the lower end part of the locking protrusion e2 and the upper end part of the guide cylinder 51 are chamfered, it is easy to push the guide cylinder 51 into the formation location of the locking protrusion e2 of the stem cylinder 60.

Further, although two vertical ribs 63 (locking protrusions e2) abut on both side edge parts of one engaging recess e1 in the shown example, the gap between the vertical ribs 63 may be set to be shorter than that in the shown example. In this case, a gap is generated between the other side edge part of the engaging recess e1 and the other vertical rib 63 in a state in which one vertical rib 63 abuts on the one side edge part of the engaging recess e1.

In the aforementioned configuration, when the piston guide B1 is fitted to the stem B2, as described above, the guide cylinder 51 is pushed into the stem cylinder 60 until it abuts on the annular rib 62, and the guide cylinder 51 is accommodated in the stem cylinder 60 as shown in FIG. 3. In the state of FIG. 3, two vertical ribs 63 enter one engaging recess e1. As described above, the guide cylinder 51 may enter the stem cylinder 60 in a state in which one of the two vertical ribs 63 is pressed against the arcuate cylinder wall part 51*a* and deformed. However, there is no problem in subsequent manipulations of the discharge pump.

In this state, when the actuating member B is screwed to the stationary suction part A, the initial state shown in FIG. 6 is obtained.

When the discharge head B4 of the actuating member B is rotated from the state of FIG. 6 to release the screwing of the actuating member B to the stationary suction part A, and the actuating member B is lifted from the stationary suction part A, the rotational force of the discharge head B4 is transferred to the piston guide B1 via the stem B2. If silicone is not applied to the inner peripheral surfaces of the annular piston B3 and the cylinder A1, or if silicone adheres to the fitting part between the piston guide B1 and the stem B2, there is a possibility that idling may occur between the stem B2 and the piston guide B1. However, as shown in FIG. 3, the vertical rib 63 as the locking protrusion e2 hits the side surface of the engaging recess e1. Therefore, the locking protrusion e2 forcibly rotates the piston guide B1 and restricts the idling thereof. As a result, since frictional resistance between the stem B2 and the piston guide B1 is maintained, the piston guide B1 is released from the inner surface of the cylinder A1, and the piston guide B1 is lifted by the force of the coil spring S.

With this configuration, the piston guide B1 is prevented from being left behind due to idling, and the discharge pump 2 functions normally.

Hereinafter, other embodiments of the present invention will be described. In the description, explanation of components the same as those in the first embodiment will not be provided.

Figure 8A:
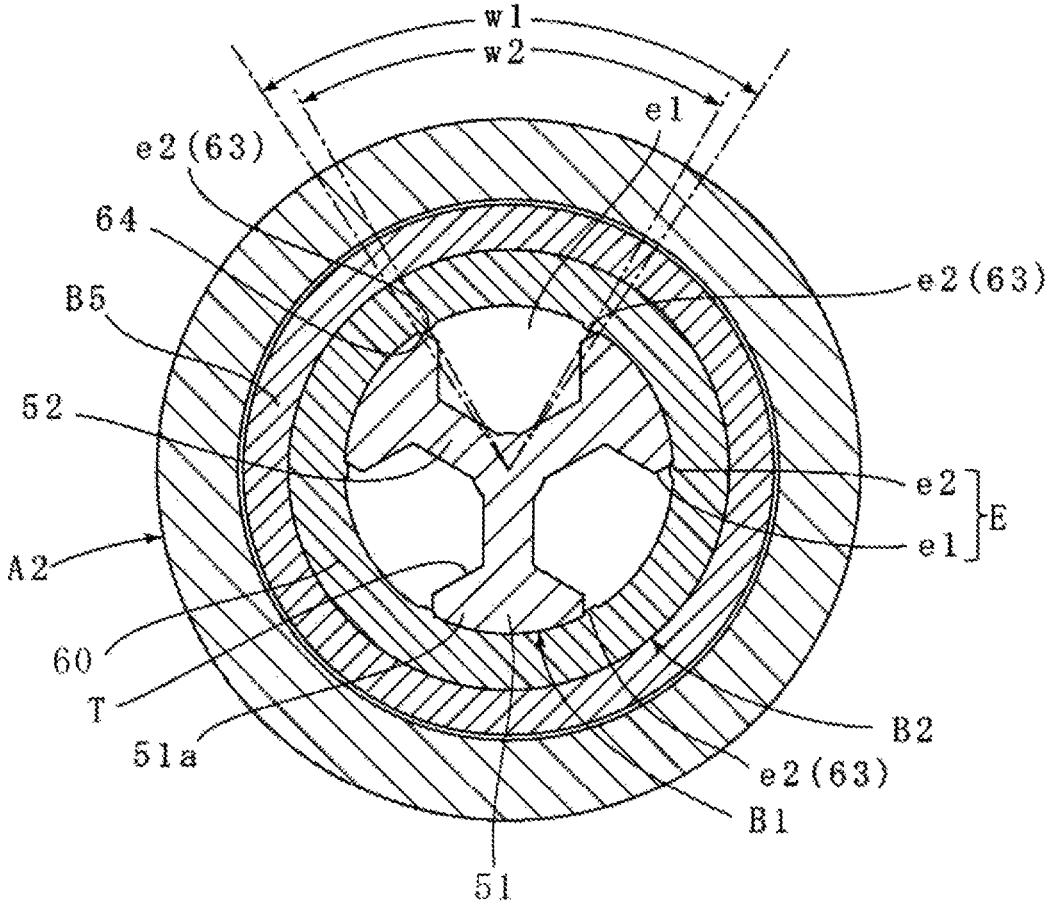
FIG. 8A is a partial cross-sectional view of a discharge pump according to a second embodiment of the present invention.
Figure 8B:
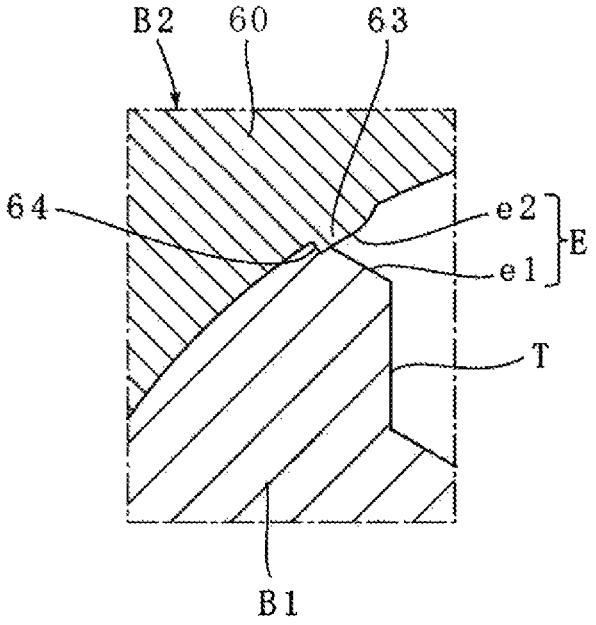
FIG. 8B is an enlarged view showing a main part of FIG. 8A.
Figure 8C:
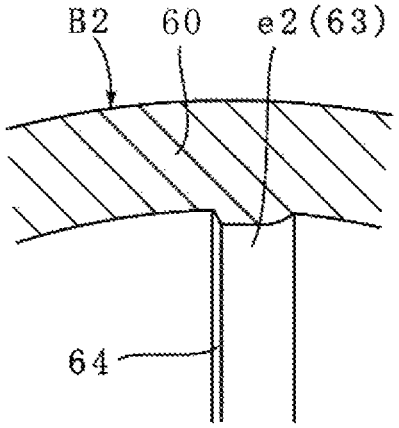
FIG. 8C is a perspective view of the main part of FIG. 8B.

FIGS. 8A to 8C show main parts of the discharge pump according to a second embodiment of the present invention. This embodiment is different from the first embodiment in the shape of the vertical rib 63. Specifically, as shown in FIG. 8B, the vertical rib 63 is formed in a shape raised as an edge on one side in the circumferential direction, and has a raised part (a corner) having a band-like engaging surface 64 extending in the vertical direction shown in FIG. 8C. When the stem B2 is rotated to one side in the circumferential direction, as shown in FIG. 8A, the band-like engaging surface 64 comes into contact with and meshes with the side surface of the engaging recess e1, thereby increasing the meshing force thereof.

This makes it possible to effectively restrict the idling between the piston guide B1 and the stem B2.

In the shown example, a left side of FIG. 8C is raised as the edge, and thus, when the stem B2 rotates counterclockwise (a direction in which the discharge head is detached from the mounting member), the band-like engaging surface 64 is configured to mesh with the side surface of the engaging recess e1.

Figure 9A:
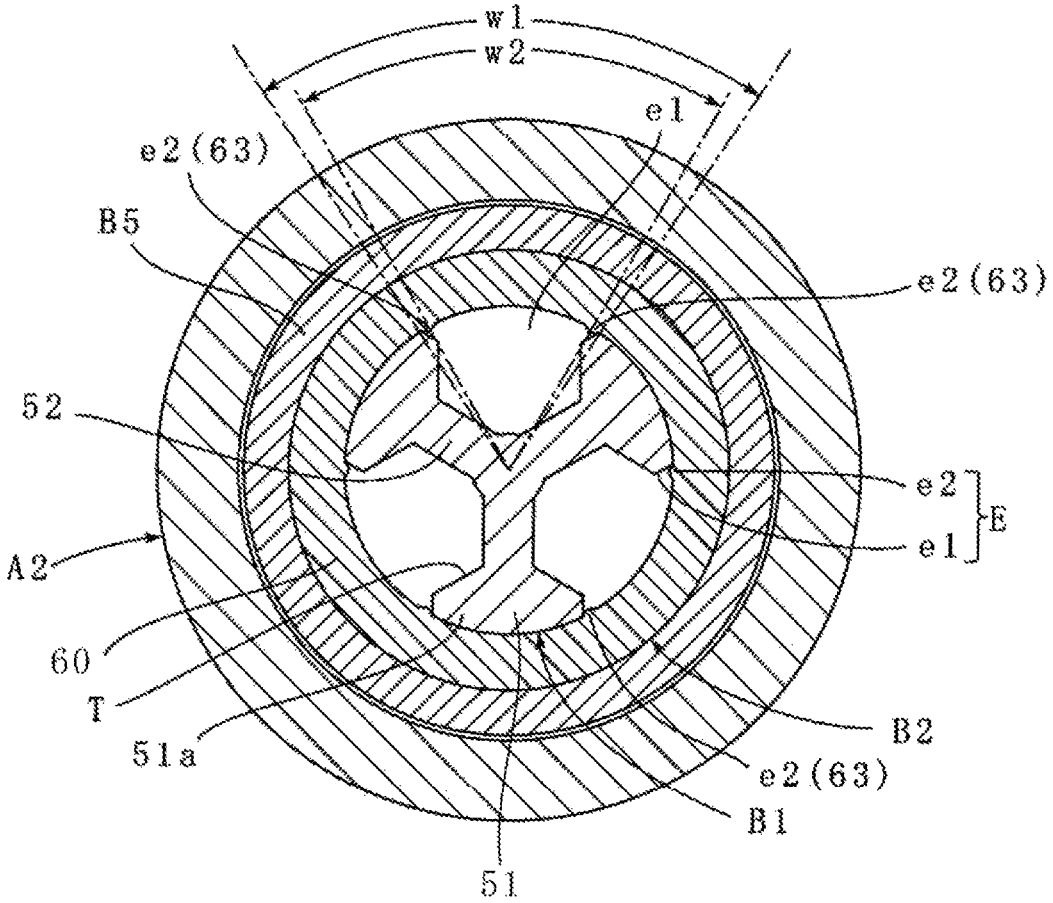
FIG. 9A is a partial cross-sectional view of a discharge pump according to a third embodiment of the present invention.
Figure 9B:
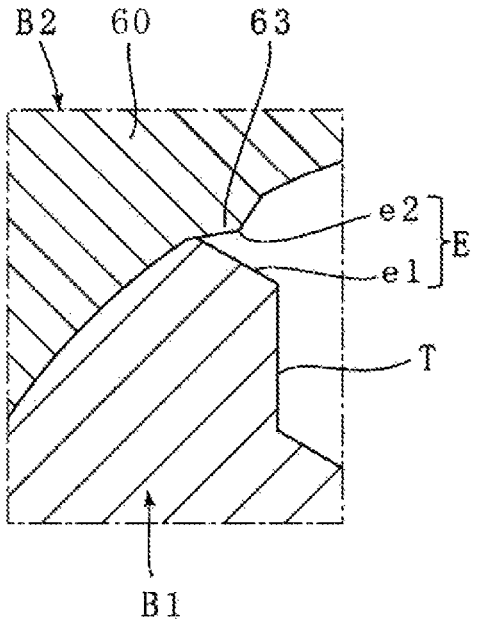
FIG. 9B is an enlarged view showing a main part of FIG. 9A.
Figure 9C:
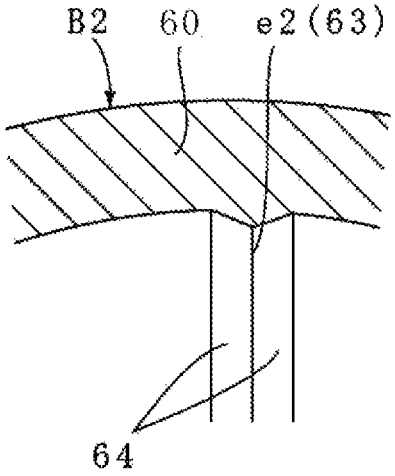
FIG. 9C is a perspective view of the main part of FIG. 9B.

FIGS. 9A to 9C show main parts of the discharge pump according to a third embodiment of the present invention. This embodiment is different from the first embodiment in the shape of the vertical rib 63. Specifically, as shown in FIG. 9B, the cross-sectional shape of the vertical rib 63 is formed in a substantially flat square shape having a height (a protruding length) lower than that of a bottom side. On both sides in the circumferential direction of the stem cylinder 60, the band-like engaging surfaces 64 extending in the vertical direction shown in FIG. 8C are provided. However, the cross-sectional shape of the vertical rib 63 may be a square shape that is taller than the bottom side.

In this case, even if the stem B2 is rotated in any direction in the circumferential direction, as shown in FIG. 9A, the band-like engaging surface 64 abuts on and meshes with the side surface of the engaging recess e1, and the meshing force is exhibited. Therefore, it is possible to effectively restrict the idling between piston guide B1 and stem B2.

In the preferred shown example, the cross-sectional shape of the vertical rib 63 is a substantially isosceles triangle. Therefore, irrespective of the direction in which the stem B2 is rotated, an equivalent meshing force can be obtained.

In the aforementioned embodiment, the engaging unit E for restricting the stein B2 and the piston guide B1 from idling each other when releasing the screwing of the actuating member B to the stationary suction part A and lifting the actuating member B from the stationary suction part A is provided in the fitting part between the stem B2 and the piston guide B1. Therefore, it is possible to prevent the piston guide B1 from being detached from the stem B2.

Further, the engaging recess e1 having an opened upper end is provided at one of the upper part of the piston guide B1 and the corresponding part of the stem B2, and the locking protrusion e2 is provided at the other of the upper part of the piston guide B1 and the corresponding part of the stem B2. Thus, when the piston guide B1 is fitted to the stem B2, since the locking protrusion e2 enters the engaging recess e1 from the opening of the upper end of the engaging recess e1, the engaging recess e1 and the locking protrusion e2 can be engaged with each other, and the assembling work of the piston guide B1 to the stem B2 is not troublesome.

Also, the locking protrusion e2 is formed as the vertical rib 63 protruding inward from the inner peripheral surface of the stem B2, extending in the vertical direction, and configured to abut on the side surface of the engaging recess e1. Therefore, even if the inward protruding length of the locking protrusion e2 (the vertical rib 63) is provided to be large, a comparatively large engaging force can be obtained.

Further, the engaging recess e1 is bored in the guide cylinder 51, as the slit groove that also serves as the liquid passage hole. Therefore, it is not necessary to greatly change the configuration of the conventional piston guide, and the engaging recess e1 can be manufactured easily.

Further, on the inner peripheral surface of the stem B2, the plurality of vertical ribs 63 are vertically provided at the constant gap w2 which is narrower than the width w1 in the circumferential direction of the engaging recess e1. As a result, when the guide cylinder 51 is inserted into the stem B2, any one of the vertical ribs 63 enters the engaging recess e1 as the locking protrusion e2, and engages with the edge part of the engaging recess e1. Therefore, there is no need to align the engaging recess e1 and the locking protrusion e2, which is convenient.

The cross-sectional shape of the vertical rib 63 is formed in a circular arc shape raised inward from the inner surface of the stem cylinder 60. Therefore, even when the guide cylinder 51 rides on the vertical ribs 63 at the time of inserting the guide cylinder 51 into the stem B2, the insertion resistance can be reduced.

Further, the vertical rib 63 has a band-like engaging surface 64 that is provided on at least one side in the circumferential direction of the stem cylinder 60 and extends in the vertical direction (a cylinder axis direction of the stem cylinder 60). This makes it possible to enhance the meshing force between the engaging recess e1 and the band-like engaging surface 64, and effectively restrict the idling between the piston guide B1 and the stem B2.

Note that the technical scope of the present invention is not limited to the above-described embodiments, and various modifications can be made without departing from the spirit of the present invention.

For example, in the aforementioned embodiment, the engaging recess e1 is provided in the piston guide B1, and the locking protrusion e2 is provided in the stem B2. However, the locking protrusion e2 may be provided in the piston guide B1, and the engaging recess e1 may be provided in the stem B2.

Further, the structure of the engaging recess e1 is not limited to the aforementioned embodiment, and any structure may be used as long as the locking protrusion e2 inserted from above can be engaged with the engaging recess e1 to prevent idling between the piston guide B1 and the stem B2. For example, the engaging recess e1 may be a penetration hole instead of a recessed structure, and may also serve as a liquid passage hole as in the shown example.

Further, the structure of the locking protrusion e2 is not limited to the aforementioned embodiments, and any structure may be used as long as the locking protrusion e2 is locked to the engaging recess e1 and functions as a rotation stopper between the piston guide B1 and the stem B2. Although the locking protrusion e2 is formed as a vertical rib in the shown example, it may not necessarily be a vertically long rib, and it may have a shape other than a rib.

The expression that the gap w2 between the vertical ribs 63 is narrower than the width w1 in the circumferential direction of the engaging recess e1 does not exclude a structure in which the two vertical ribs 63 abut on both side edges of one engaging recess e1 as shown.

Further, the term "substantially flat" means that the height of the vertical rib 63 is low (a raised length is short) to such an extent that the vertical rib 63 deformed by the pressure contact with the outer surface of the guide cylinder 51 does not hinder the piston guide B1 from being inserted into the stem B2.

INDUSTRIAL APPLICABILITY

According to the present invention, it is possible to provide a discharge pump capable of restricting the piston guide from being left behind from the stem when the actuating member is screwed up at the stage of initial use.

REFERENCE SIGNS LIST

2 Discharge pump
A Stationary suction part
A1 Cylinder
4 Annular bottom wall
6 Peripheral wall
6*a* First peripheral wall part
6*b* Second peripheral wall part
6*c* Third peripheral wall part
10 First check valve seat
12 Pipe fitting cylinder part
14 Outward flange
15 Packing
16 Extension wall part
18 Outside air introduction hole
20 Pipe
A2 Ring cap
25 Inner fitting cylinder part
26 Outer fitting cylinder part
27 Top plate
28 Cap peripheral wall
29 Extension portion
A3: Mounting member
30 Mounting cylinder part
31 Inward flange-like top wall part
A4 Suction valve member
40 Leg cylinder part
41 Elastic connecting piece
42 First check valve plate
43 Connecting part
44 Pedestal part
44*a* First reinforcement wall part
B Actuating member
B1 Piston guide
50 Bottom wall
51 Guide cylinder
51*a* Arcuate cylinder wall part
52 Second reinforcement wall part
53 Outward flange-like wall part
54 Second check valve seat
55 Seal cylinder part
56 Space rib
57 Pointed end part
B2 Stem
60 Stem cylinder
60*a* Large-diameter cylinder part
60*b* Reduced-diameter part
60*c* Small-diameter cylinder part
61 Upward stepped part
62 Annular rib
63 Vertical rib
64 Band-like engaging surface
B3 Annular piston
71 Outer cylinder part
71*a* Reverse skirt-like seal part
71*b* Skirt-like seal part
72 Inner cylinder part
72*a* Inside upper seal part
72*b* Second check valve body
73 Connection wall part
B4 Discharge head
80 Top wall
81 First connection cylinder part
82 Downward stepped part
83 Second connection cylinder part
84 Head peripheral wall
85 Nozzle
B5 Blocking cylinder member
90 Base cylinder part
91 Sliding blocking part E Engaging unit
e1 Engaging recess
e2 Locking protrusion
L Stationary part
P Liquid passage
S Coil spring
T Padding part
V1 First check valve
V2 Second check valve
w1 Width of engaging recess in a circumferential direction
w2 Gap between locking protrusions (vertical ribs)
100 Container body
102 Neck part

The invention claimed is:

1. A discharge pump comprising:

a stationary suction part which includes a cylinder having a first check valve at a lower part thereof, and a mounting member to be mounted on a neck part of a container body, the cylinder being capable of being vertically provided to an inside of the container body via the mounting member; and an actuating member which includes a discharge head, a stem hanging down from the discharge head, a piston guide having an upper part fitted to the stem, and an annular piston attached to an intermediate part in a vertical direction of the piston guide, the annular piston being configured to freely move up and down in the vertical direction and to come into sliding contact with an inner peripheral surface of the cylinder, a second check valve being formed between a lower end part of the annular piston and a lower part of the piston guide, wherein:

the stationary suction part and the actuating member are configured such that:

when not in use, the actuating member is screwed to the stationary suction part in a state in which the actuating member is lowered with respect to the cylinder to a lowest position in the vertical direction, and when in use, screwing of the actuating member to the stationary suction part is released, the actuating member is raised from the stationary suction part and is provided to be vertically movable with respect to the cylinder, and by vertical movement of the actuating member, liquid in the container body is sucked up into the cylinder via the first check valve, and the liquid in the cylinder is discharged from the discharge head via the second check valve, an engaging unit is provided in a fitting part between the stem and the piston guide, the engaging unit being configured to restrict the stem and the piston guide from rotating relative to each other when screwing of the actuating member to the stationary suction part is released and the actuating member is raised from the stationary suction part, the engaging unit is formed by:

an engaging recess which is provided on one of the upper part of the piston guide and a corresponding part of the stem corresponding to the upper part of the piston guide, and a locking protrusion which is provided on an other of the upper part of the piston guide and the corresponding part of the stem and is engaged with the engaging recess, and the engaging recess has an open upper end, and the locking protrusion is capable of being inserted into the engaging recess from an upper end side.

2. The discharge pump according to claim 1, wherein the locking protrusion is formed as a vertical rib protruding inward from an inner peripheral surface of the stem, extending in the vertical direction, and configured to abut on a side surface of the engaging recess.

3. The discharge pump according to claim 2, wherein:

the piston guide has a bottom wall, and a guide cylinder erected from a peripheral edge of the bottom wall and fitted to the stem, a second check valve seat being formed outside a lower part of the guide cylinder, the engaging recess is a slit groove formed from the lower part to an upper end of a cylinder wall of the guide cylinder, and the slit groove is configured to also serve as a liquid passage hole of the guide cylinder, and the vertical rib is attached to a portion of the inner peripheral surface of the stem corresponding to the upper part of the guide cylinder.

4. The discharge pump according to claim 3, wherein:

a plurality of the vertical ribs are vertically provided on the inner peripheral surface of the stem at regular gaps narrower than a width in a circumferential direction of the engaging recess, and when the guide cylinder is inserted into the stem, at least one of the vertical ribs is configured to enter the engaging recess, and the vertical ribs are formed to a size such that a vertical rib which does not enter the engaging recess and is deformed by being pressed against the outer surface of the guide cylinder does not hinder insertion of the guide cylinder into the stem.

5. The discharge pump according to claim 4, wherein a cross-sectional shape of the vertical rib is formed in a circular arc shape raised inward from the inner peripheral surface of the stem.

6. The discharge pump according to claim 4, wherein the vertical rib has a band-like engaging surface which is provided on at least one side in the circumferential direction of the stem and extends in the vertical direction.

* * * * *